US005363786A

United States Patent [19]

Hampel et al.

[11] Patent Number: 5,363,786

[45] Date of Patent: Nov. 15, 1994

[54] THREAD TENSIONING DEVICE HAVING AN ELECTROMAGNET FOR APPLYING A VARIABLE FORCE OPPOSING ROTATION OF A TENSIONING ELEMENT

[75] Inventors: Klaus Hampel, Bielefeld; Gunter Pries, Leopoldshohe; Wilfried Goldbecker, Steinhagen, all of Germany

[73] Assignee: Dürkopp Adler Aktiengesellschaft, Germany

[21] Appl. No.: 990,739

[22] Filed: Dec. 15, 1992

[30] Foreign Application Priority Data

Dec. 19, 1991 [DE] Germany ..... 4141945

[51] Int. Cl.[5] ..... D05B 47/04

[52] U.S. Cl. ..... 112/255; 242/150 R

[58] Field of Search ..... 112/254, 255, 302; 242/150 M, 150 R, 147 R

[56] References Cited

U.S. PATENT DOCUMENTS 2,698,590 1/1955 Garbe ..... 112/254

2,937,605 5/1960 Dunn et al. ..... 112/254

*Primary Examiner*—Clifford D. Crowder

*Assistant Examiner*—Paul C. Lewis

[57] ABSTRACT

A thread tensioning device comprising a stationary electromagnet mounted on a sewing machine arm and a tensioning wheel having a relatively low mass. The tensioning wheel is rotatable concentric to a longitudinal axis of the electromagnet and is mounted on the electromagnet so as to be moveable only slightly in the direction of the longitudinal axis. A friction disk is positioned at one end of the electromagnet so as to be between the electromagnet and the tensioning wheel. A current flows through an excitation winding in the electromagnet and its value is varied within given limits by a suitable current control device, thereby causing the electromagnet to pull a flat side of the tensioning wheel with corresponding force against an application side of the friction disk, whereby a corresponding variable thread tensioning force is applied to a sewing thread passing through the tensioning wheel to the sewing machine.

19 Claims, 4 Drawing Sheets

THREAD TENSIONING DEVICE HAVING AN ELECTROMAGNET FOR APPLYING A VARIABLE FORCE OPPOSING ROTATION OF A TENSIONING ELEMENT

BACKGROUND OF THE INVENTION

The present invention relates to a thread tensioning device for a sewing machine. More particularly, the present invention relates to a device for applying a variable thread tensioning force to a sewing thread.

DESCRIPTION OF A PRIOR ART EMBODIMENT

A sewing machine having a thread tensioning device for applying a variable thread tensioning force to a sewing thread is known from German Patent 917,886, which corresponds with U.S. Pat. No. 2,698,590. The disclosures of this and all other prior art materials mentioned herein are expressly incorporated by reference.

The known sewing machine comprises a sewing machine arm within which a horizontally mounted arm shaft is provided. A tensioning element mounted on the sewing machine is functionally connected to a compression spring so that the tensioning element is engaged by the adjustable force of the compression spring. The tensioning element comprises two tensioning disks between which sewing thread is fed to the sewing needle. A thread tensioning force, which is a function of the active force of the compression spring, is imposed by the tensioning element on the sewing thread.

The known thread tensioning device comprises an axially displaceable pin disposed along a longitudinal axis of the tensioning device. The pin is firmly attached to a soft iron core. The soft iron core is a part of an electromagnet which is mounted on the arm of the sewing machine. A voltage from a generator, mounted on the arm shaft, is fed to the excitation coil of the electromagnet. The soft-iron core, which acts as an armature, is drawn into the excitation coil and thus into the electromagnet when the voltage produced by the generator is applied to the excitation coil of the electromagnet. The force of attraction of the electromagnet becomes greater as the voltage produced by the generator is increased. The voltage produced by the generator is, in turn, determined by the speed of rotation of the arm shaft on which the generator is mounted. Therefore, the greater the speed of rotation of the arm shaft, the higher is the voltage produced by the generator.

One end of the compression spring rests against a check disk, which is disposed at the free end of the pin that is fastened to the soft-iron core. The other end of the compression spring presses against the tensioning disks. Therefore, as the soft-iron core is pulled into the electromagnet by the force of attraction produced by the voltage applied to the excitation coil of the electromagnet which, as previously described, is a function of the speed of rotation of the arm shaft, the compression spring is compressed, so that the spring exerts increased pressure on both tensioning disks. A greater thread tensioning force is thereby applied to the sewing thread which is pulled between the two tensioning disks, the amount of tensioning force being dependent on the speed of rotation of the arm shaft.

The prior art thread tensioning device has the disadvantage that the axially movable parts, namely the soft-iron core and the parts such as the bolt, check disk, and fastening element functionally connected with the core, have a relatively large mass. The large mass of these movable parts produces an inertial force which acts on the thread tensioning device.

In high-speed industrial sewing machines oscillations take place in the machine which are directed at right angles to the path of movement of the needle bar of the sewing machine. These oscillations which can run along the longitudinal axis of the thread tensioning device have acceleration values of 15 to 20 meters/second$^2$. The inertial force produced along the longitudinal axis of the thread tensioning device is a product of the acceleration of the oscillation and the mass of the movable parts. Depending on the phase of the oscillations, the inertial force increases or reduces the thread tensioning force set for the sewing machine. Therefore, the tensioning force is subject to considerable variations. These variations in the thread tensioning force are a function of the speed of rotation of the machine (speed of rotation of the arm shaft) and of the mass of the parts which are movable along the longitudinal axis of the thread tensioning device. These variations in the tensioning force have an undesirable effect on the sewing done by the sewing machine.

SUMMARY OF THE INVENTION

Therefore, an object of the present invention is to develop a thread tensioning device in which only minimal inertial forces in addition to the predetermined thread tensioning force act on the sewing thread during its passage through the thread tensioning device.

These and other objects of the present invention are achieved by a thread tensioning device mounted on a sewing machine. The thread tensioning device applies a variable thread tensioning force to a sewing thread fed during the sewing process. The thread tensioning force is produced by an electromagnet and a tensioning element which is functionally connected with the electromagnet. The force of attraction of the electromagnet is varied by influence of its excitation winding so as to vary the thread tensioning force applied to the sewing thread passing through the tensioning element during the sewing process. The thread tensioning device comprises the electromagnet which is mounted on the sewing machine arm, and a tensioning element of low mass which is turnable concentric to a longitudinal axis of the electromagnet. The tensioning element is mounted on the electromagnet so that the tensioning element is practically free of play in the direction of the longitudinal axis of the electromagnet.

In the thread tensioning device of the present invention, an advantageous result is obtained because the thread tensioning device has a single movable structural part, namely a tensioning wheel. The tensioning wheel may be formed of a single part or of two parts. The tensioning wheel is attached to the electromagnet in a manner such that only slight axial movement is permitted for the tensioning wheel with reference to the electromagnet. Due to the small mass of the tensioning wheel, the inertial force produced is kept very small. Therefore, the range of variation of the thread tensioning force, as compared to a predetermined desired value, is relatively small. The use of the tensioning wheel is advantageous since as a result of the tensioning wheel, the operation of the thread tensioning device is independent of the thickness of the sewing thread used.

A tensioning wheel of background interest, with a plurality of radially extending fingers, which are bent alternately outward so as to form a V-shaped incision, is known in the prior art (German AS 1 138 610; corresponding to U.S. Pat. No. 2,937,605).

The present invention includes other advantageous features of the thread tensioning device such as a friction disk fastened to one end of the electromagnet. In one embodiment of this invention, the electromagnet has a continuous passage formed along its longitudinal axis which passage receives the shank of a bolt. An application (friction) side of the friction disk is positioned so as to extend substantially perpendicularly to the shank and the tensioning element, which advantageously may be the tensioning wheel, is mounted between the friction disk and the head of the bolt.

In one embodiment of the present invention, the bolt is constructed of non-magnetizable material and the diameter of the head of the bolt is substantially greater than the diameter of the shank of the bolt. In another embodiment, the bolt is constructed of magnetizable material and the diameter of the head of the bolt is slightly greater than the diameter of the shank. A control device acts on the excitation winding of the electromagnet so that a flat side of the tensioning wheel is pressed by a variable force against the application side of the friction disk whereby variable thread tensioning force is applied to the sewing thread.

Other features and advantages of the various embodiments of the present invention will become apparent from the following description of the embodiments of the invention which refers to the accompanying drawings.

DETAILED DESCRIPTION OF EMBODIMENTS OF THE INVENTION

Figure 1:
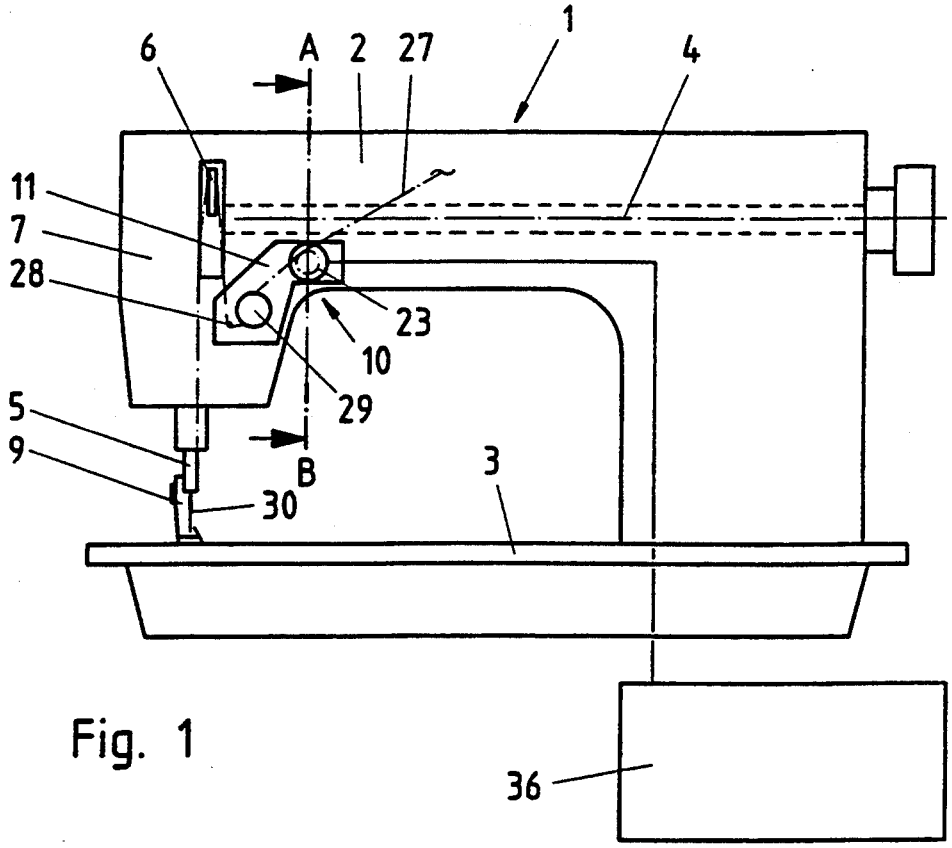
FIG. 1 is a front view of an embodiment of the thread tensioning device according to the present invention fastened to the arm of a sewing machine.
Figure 2:
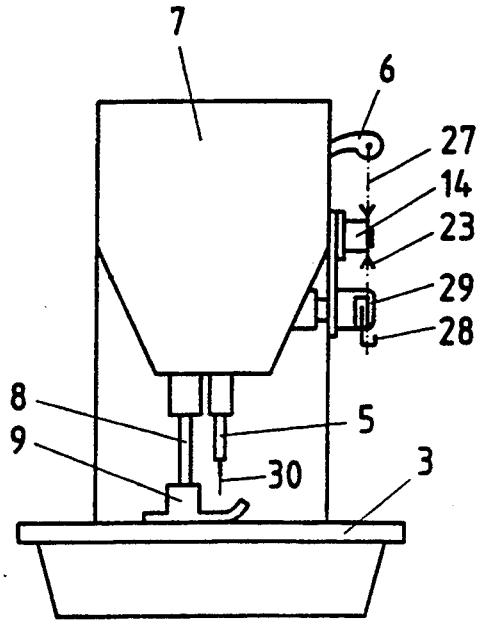
FIG. 2 is a side view with the thread tensioning device fastened on the sewing machine arm.

FIG. 1 shows an industrial sewing machine 1 of known construction which comprises a sewing machine arm 2 and a base plate 3. The arm 2 is firmly attached to the base plate 3. In the sewing machine arm 2, an arm shaft 4 is mounted, in a known manner. The arm shaft 4 drives the stitching elements of the sewing machine. The stitching elements comprise a needle bar 5 which can move up and down, a thread lever 6 which is movable over a curved path, a feed dog (not shown) and a shuttle (also not shown) arranged below the base plate 3. These stitching elements are well known and, therefore, need not be further described here. In a front region of the arm 2 there is an arm head 7, in which the needle bar 5 and a foot bar 8 are mounted (FIG. 2). A presser foot 9 is attached to the foot bar 8.

Figure 3:
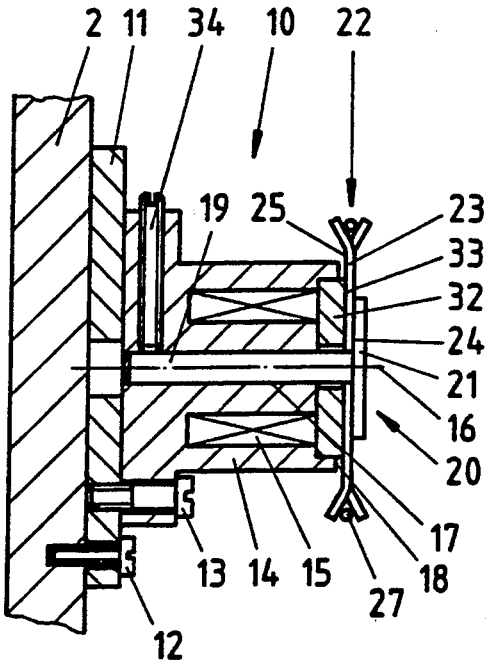
FIG. 3 is a section through the thread tensioning device along the section line A–B in FIG. 1.
Figure 4:
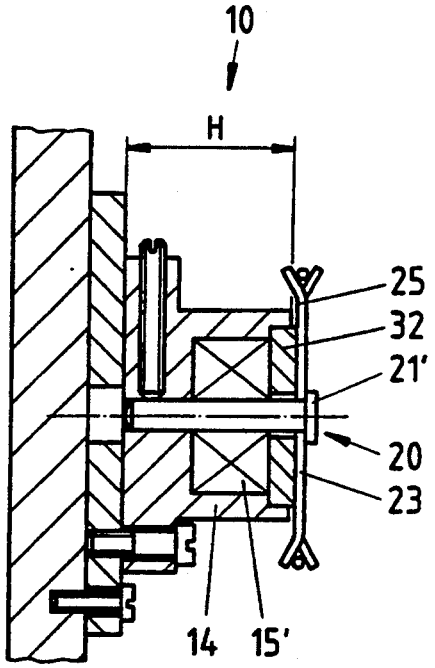
FIG. 4 is a section through another embodiment of the thread tensioning device having a smaller structural height, seen along the section line A–B in FIG. 1.

On the arm head 7 of the sewing machine arm 2, a thread tensioning device 10 is provided. The thread tensioning device 10 comprises a plate 11 which is fastened to the arm 2 and the arm head 7 by means of screws 12 shown in FIG. 3. An electromagnet 14 is rigidly attached to the plate 11 by screws 13. The electromagnet 14 is developed in the shape of a pot magnet, and contains an excitation winding 15, 15′ within it (FIGS. 3 and 4). Along a longitudinal axis 16 of the electromagnet 14, a continuous hole 17 is provided. At the outward end 18 of the electromagnet 14, a friction disk 32 is fastened to the electromagnet 14. The friction disk 32 has an outwardly facing application side 33. The application side 33 of the friction disk 32 extends from the hole 17 so as to be substantially perpendicular to the hole 17. The friction disk 32 is made of a non-magnetizable material having a high coefficient of friction such as, for example, the friction facing of a friction coupling.

As shown in FIG. 3, the hole 17 receives a shank 19. The shank 19 is part of a bolt 20 made, in one embodiment, of non-magnetizable material. A flat head 21 is provided on the free end of the shank 19 which extends out of the hole 17. In this embodiment, the bolt 20 serves solely as a radial and axial bearing part for the tensioning wheel 23. Accordingly, because of the material of the bolt 20, it does not affect the magnetic field of the electromagnet 14.

As shown in FIG. 3, a tensioning element 22 is provided between the electromagnet 14 and the head 21 of the bolt 20. The bolt 20 serves as means for mounting the tensioning element 22 on the sewing machine 1 and for defining a rotational axis for the tensioning element 22. The tensioning element 22 comprises a tensioning wheel 23 which is light in mass. The tensioning wheel 23 used in the tensioning element 22 is of the type previously known in the art. Accordingly, depending on the construction, the outside diameter of the tensioning wheel 23 could, for example, be in the range 20 to 40 millimeters, and could have a mass in the range of 2.0 to 14.0 grams. Irrespective of its construction, the tensioning wheel 23 may be advantageously made of a magnetizable material such as, for example, low carbon steel. As shown in FIG. 3, the tensioning wheel 23 rests against an inwardly facing surface 24 of the flat shank head 21.

Figure 7:
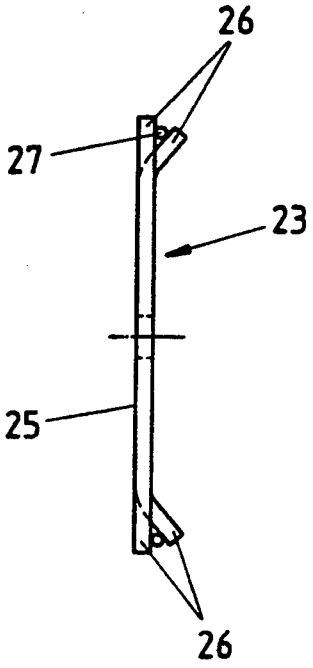
FIG. 7 is a side view of a single-piece tensioning wheel with a flat application side on the left side.
Figure 5:
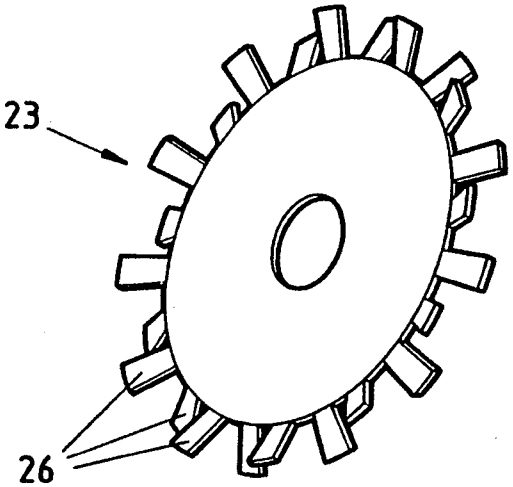
FIG. 5 is a perspective view of one embodiment of a tensioning wheel according to the present invention developed as a single piece.

As shown in FIGS. 5 and 7, the tensioning wheel 23 comprises a disk developed from a single piece which on its left has a flat side 25. The periphery of the tensioning wheel 23 has a plurality of fingers 26 which extend in radial direction. These fingers 26 are bent, alternately in opposite directions, and thereby form a V-shaped incision, as shown in FIG. 5. A sewing thread 27 coming from a thread supply (not shown) is wound, as shown in FIGS. 1 and 2, around the tensioning wheel 23 and passes therefrom to a thread tensioning spring 28. The thread tensioning spring 28 is developed as a torsion spring and is contained in a housing 29. The thread tensioning spring 28 is not described in further detail here because it is well known. As shown in FIG. 1, the sewing thread 27 is guided, from the thread tensioning spring 28 to the thread lever 6 and from there to a sewing needle 30, where it is threaded through the eye of the needle 30.

Figure 6:
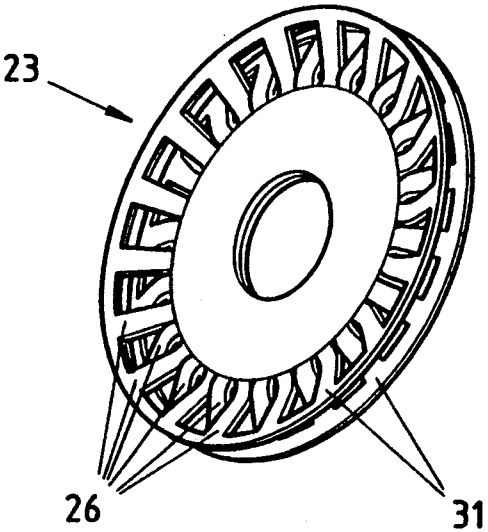
FIG. 6 is a perspective view of another embodiment of the tensioning wheel comprising two pieces.

In another embodiment of the present invention, shown in FIG. 6, the tensioning wheel 23 comprises two disks which are firmly attached to each other by, for instance, spot welding. A surrounding circumferential flange 31 is provided at the end of the plurality of fingers 26.

One particularly suitable embodiment of the one piece tensioning wheel 23 is shown in FIG. 7. In this embodiment, the tensioning wheel 23 comprises a disk developed from a single piece which on its left side has a flat side 25. The periphery of the tensioning wheel 23 has a plurality of fingers 26 which extend in radial direction. Alternate fingers of the fingers 26 are bent, and thereby form a V-shaped incision, as shown in FIG. 7. This embodiment of the tensioning wheel 23 is particularly advantageous because the side 25 can be made very flat by grinding. The flat side 25 of the tensioning wheel 23, in this embodiment, produces an excellent friction lock between the friction disk 32 and the tensioning wheel 23.

The bolt 20 ensures that there is only slight axial movement (i.e., not greater than approximately 0.1 mm) of the tensioning wheel 23 in the direction of the longitudinal axis 16, upon activation of the electromagnet 14. A lock screw 34 is disposed radially in the electromagnet 14, as shown in FIG. 3, so as to adjustably lock the bolt 20 in position.

As shown in FIG. 3, the head 21 of the bolt 20 is of a diameter that is substantially greater than the diameter of the shank 19. In another embodiment, shown in FIG. 4, the bolt 20 is constructed of magnetizable material. In this embodiment, the head 21' of the bolt 20 is of a diameter that is slightly greater than the diameter of the shank 19. In contrast with the bolt 20, shown in FIG. 3, the bolt 20 of the embodiment in FIG. 4 serves as a radial and axial bearing part for the tensioning wheel 23, and also serves as a magnetic flux conducting part. Accordingly, the head 21' of the bolt 20 in the embodiment in FIG. 4 has a relatively smaller diameter than the head 21 of the bolt 20 in FIG. 3 so as not to negatively affect the magnetic field.

The bolt 20 is positioned with respect to the inwardly facing surface 24 of the head 21, 21' and with respect to the application side 33 of the friction disk 32 in a manner so that the tensioning wheel 23 is mounted practically free of play on the bolt 20 and, therefore, on the electromagnet 14.

In another embodiment of the present invention, shown in FIG. 4, the inside diameter of the excitation winding 15' of the electromagnet 14 is sized so that the excitation winding 15' directly surrounds the shank 19 of the bolt 20. Therefore, compared with the embodiment shown in FIG. 3, the same amount of winding as in the excitation winding 15 can be provided in the embodiment shown in FIG. 4 with an excitation winding 15' of smaller width. As FIG. 4 very clearly shows, the structural height H of the electromagnet 14 can thereby be reduced. However, if the structural height of the electromagnet 14 shown in FIG. 3 is retained in the embodiment of FIG. 4, a larger amount of winding can be arranged in the excitation winding 15', so that the force of attraction of the magnet formed will be greater than that of the electromagnet 14 shown in FIG. 3.

Figure 8:
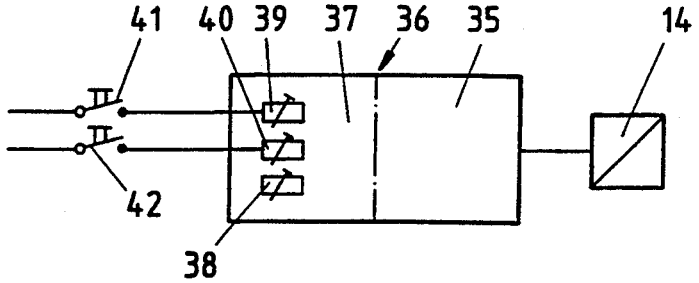
FIG. 8 shows schematically one embodiment of a control device according to the present invention for regulating the current of the electromagnet.
Figure 9:
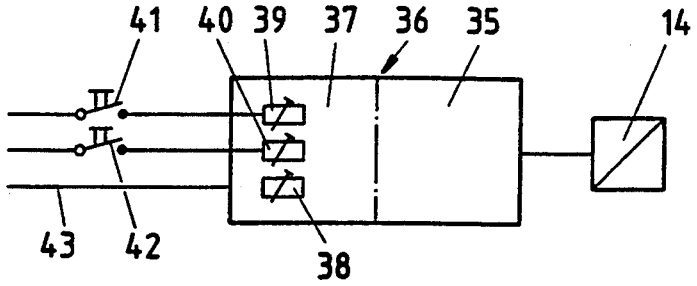
FIG. 9 shows schematically another embodiment of a control device for regulating the current of the electromagnet in which a control signal for reducing the thread tensioning force upon the cutting of the thread is fed to the control device.
Figure 10:
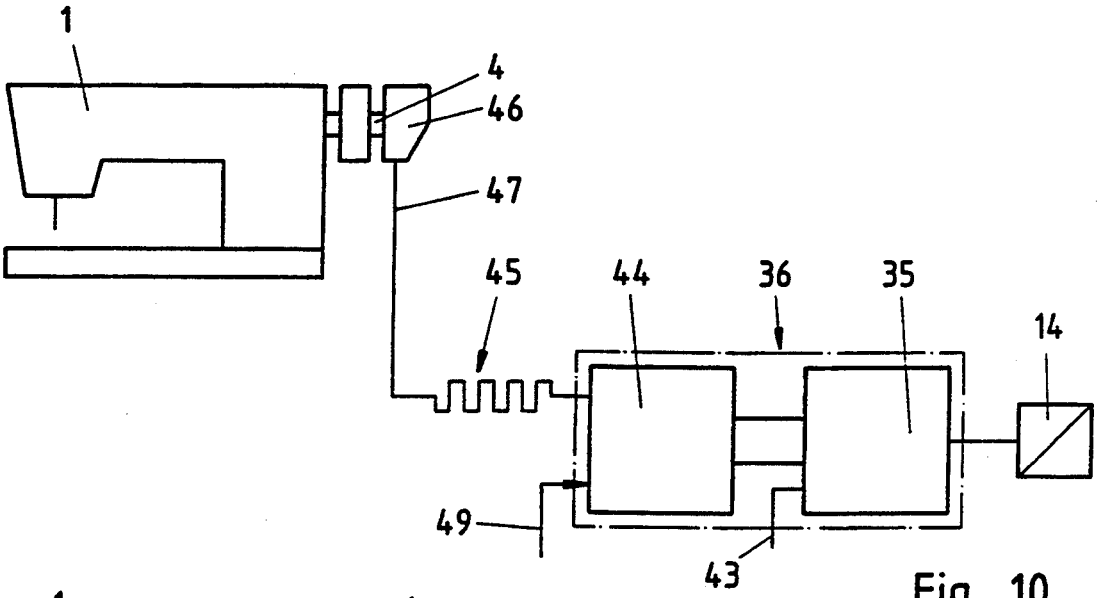
FIG. 10 shows schematically yet another embodiment of a control device for regulating the current of the electromagnet in which the regulation of the current is effected automatically in proportion to the speed of rotation of the arm shaft.

Shown in FIGS. 8–10 are embodiments of the present invention including an arrangement to change the force of attraction of the electromagnet 14 to obtain a variable friction force between the tensioning wheel 23 and the friction disk 32. A current regulator 35, which is part of a control device 36, is arranged in front of the excitation winding 15, 15' of the electromagnet 14. By varying the frictional force exerted by the friction disk 32 on the tensioning wheel 23, a greater or lesser thread tensioning force is imposed upon the sewing thread 27 which passes through the thread tensioning device 10. To change the force of attraction of the electromagnet 14, and thereby varying the frictional force exerted by the friction disk 32, the current intensity of the current flowing through the excitation winding 15, 15' is adjusted.

The regulation of the current flowing through the excitation winding 15, 15' is achieved by the embodiments of the present invention described hereafter.

The embodiment shown in FIG. 10 is preferred for providing automatic adaptation of the thread tensioning force acting on the sewing thread 27 to the speed of rotation of the arm shaft 4 during the sewing, including a reduction of the thread tensioning force upon the cutting of the thread 27. As shown in FIG. 10, the control device 36 includes a module 44 and the current regulator 35. The current regulator 35 is operated in this embodiment without manual analog range and current adjustment. The module 44 assures automatic adjustment, proportional to the speed of rotation of the arm shaft 4, of the current flowing into the electromagnet 14. Control signals 45 are conducted from a position indicator 46 of a sewing drive (not shown) of the sewing machine 1 via a line 47 to the module 44. The position indicator 46 is mounted on the protruding end of the arm shaft 4 mounted in the sewing machine arm 2. The arm shaft 4, as well as the position indicator 46, are known in the art, so a further description is dispensed with here. The transmission behavior, which pertains to the automatic setting of the corresponding current proportional to the speed of rotation of the arm shaft, can be selected, for instance, via an EPROM. With the EPROM and a digital/analog converter arranged behind it, any desired relationships can be selected pertaining to the arm shaft speed of rotation and the corresponding current. By means of different EPROM ranges, different current ranges can also be selected.

In accordance with the embodiment in FIG. 10, remote control of the module 44 is possible if a further line 49 leads to the module 44. A control signal which causes a reduction in the thread tensioning force upon the cutting of the thread 27 is fed, via the line 43, into the current regulator 35. In the case of fine-step solutions in accordance with the embodiment in FIG. 10, increased demands are made on the response time behavior of the electromagnet 14 and of the current controller 35.

In another embodiment, shown in FIG. 8, the control device 36 includes means for adjusting the thread tensioning force acting on the sewing thread. This embodiment is suitable for sewing with different thread tensioning forces acting on the sewing thread 27. In FIG. 8, the control device 36 comprises a setting device 37 and the current regulator 35. The control range of the current regulator 35 is adjustable. In this embodiment, the thread tensioning force in the sewing thread 27 can be manually adjusted in an operating range as required for the sewing. Within the operating range set, two or more current values can be preset via the controllers 39, 40. These preset current values can be called up, for instance, via the switches 41, 42. The range controller 38 as well as the controllers 39, 40 are parts of the setting device 37, while the switches 41, 42 can either be provided outside the control device 36 (as shown in FIG. 8) or, can be integrated within the setting device 37. In the embodiment shown in FIG. 8, no particular demands are made on the current controller 35 or the electromagnet 14 with respect to their response time.

In the embodiment shown in FIG. 9, the control device 36, like that in FIG. 8, is suitable for sewing with different thread tensioning forces acting on the sewing thread 27, and also includes means for the reduction of the thread tensioning force upon the cutting of the thread. The control device 36 is similar to that described above in connection with the embodiment in FIG. 8. In the embodiment shown in FIG. 9, however, a control signal which causes a reduction in the thread tensioning force upon the cutting of the thread 27 is fed into the control device 36 via a line 43. The thread tensioning force is reduced to zero in almost all applications of this feature.

Figure 11:
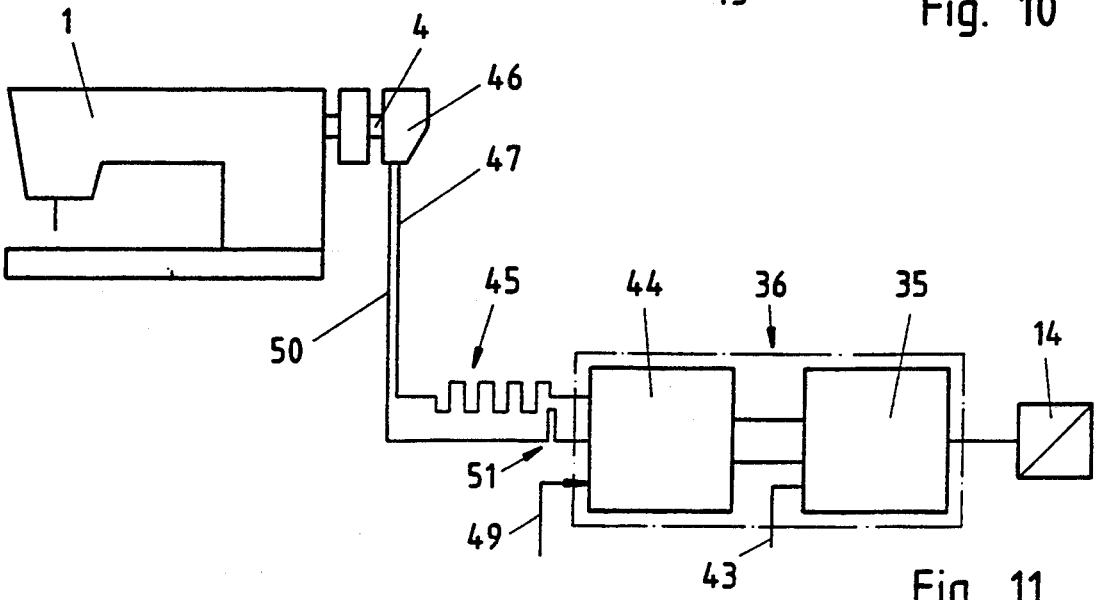
FIG. 11 shows another embodiment of a control device for regulating the current of the electromagnet in which the regulation of the current is effected automatically in proportion to the speed of rotation of the arm shaft and with which, furthermore, control of the thread tensioning force within a stitch is possible.

In the embodiment shown in FIG. 11, the control device 36 includes means suitable to vary the thread tensioning force acting on the sewing thread 27 within the cycle of a stitch which is to be produced over a predetermined angle of rotation of the arm shaft 4. This embodiment is also suitable to automatically compensate for a phase displacement due to different speeds of rotation (RPM-rates) of the arm shaft 4 so that the thread tensioning force is automatically adapted to the actual speed of rotation of the arm shaft 4. The control device 36 is similar to that described above in connection with the embodiment in FIG. 10. However, in the embodiment in FIG. 11, starting from the position indicator 46, a null pulse 51 is fed via another line 50 into the module 44. Control of the current value is therefore possible with phase compensation based on the angle of rotation of the arm shaft 4.

The arm shaft angle determined by the rotation of the arm shaft 4, within which a change in the thread tensioning force is effected during a stitch is dependent on the characteristics of the sewing machine 1 as well as on the material to be sewn. Due to the response time of the electromagnet 14 of the thread tensioning device 10, this angle must be corrected as a function of the actual speed of rotation of the arm shaft 4. For synchronization, there is necessary, in addition to the increments for the recognition of the angular position and of the speed of rotation of the arm shaft 4, the null pulse 51 per rotation of the arm shaft 4, which pulse—as stated further above—is fed via the line 50 into the module 44 of the control device 36.

In the embodiment shown in FIG. 11, high demands are made on the response time behavior of the electromagnet 14 and of the current controller 35.

The manner of operation of the thread tensioning device of the invention will now be described.

By means of the control device 36, the current flowing in the excitation winding 15, 15′ of the electromagnet 14 is adjusted so as to pull the flat side 25 of the tensioning wheel 23 mounted on the electromagnet 14 with a predetermined force against the application side 33 of the friction disk 32 which is fastened to the electromagnet 14. Due to the practically play-free mounting of the tensioning wheel 23, its axial movement caused by the electromagnet 14 is extremely slight (i.e., not greater than approximately 0.1 mm) and, as a result of the small mass of the tensioning wheel 23, a minimum inertial force is produced by the axial movement just mentioned. As a result, the influence of the inertial force on the thread tensioning force exerted on the sewing thread 27 by the thread tensioning device 10 is negligibly small.

In the embodiments shown in FIGS. 8 and 9, the aforementioned adjustment of the instantaneous current flowing through the excitation winding 15, 15′ is effected manually. Within an operating range which is set by actuation of the range controller 38, several current values which have been preset by means of the controllers 39 and 40 can be called up by actuation of the switches 41 and 42, respectively.

In the embodiments shown in FIGS. 10 and 11, adjustment of the instantaneous current is effected by an automatic control which is dependent on the speed of rotation of the arm shaft 4.

The sewing thread 27, which is withdrawn from an external thread supply (not shown) and wraps around the tensioning wheel 23, is received, as shown in FIG. 7, by the V-shaped fingers 26. The amount of sewing thread 27 necessary for the formation of the stitch is thus withdrawn in known manner from the external thread supply during the sewing. The tensioning wheel 23 carries out an angular step in the form of a partial rotation which corresponds to the amount of sewing thread 27 withdrawn. For this purpose, the tensioning wheel 23 overcomes the frictional force caused by the activated electromagnet 14, whereby a specific thread tensioning force is imposed upon the sewing thread 27. This force is adjusted by the control device 36, which controls the current as described above.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A thread tensioning device for a sewing machine comprising:

a tensioning element of low mass for applying a tensioning force to a sewing thread, the tensioning element being mounted on the sewing machine, the sewing thread passing circumferentially around the tensioning element so as to rotate the tensioning element as the sewing thread is fed to the sewing point during operation of the sewing machine, mounting means mounted on the sewing machine and defining a rotational axis for the tensioning element, the tensioning element being rotatably mounted on the mounting means such that the tensioning element has a slight predetermined amount of axial movement with respect to the sewing machine along an axial direction extending through the mounting means; and means including an electromagnet having an excitation winding, the electromagnet being mounted on the sewing machine, for applying a variable force opposing rotation of the tensioning element in response to varying current in the excitation winding, thereby applying a variable thread tensioning force to the sewing thread, wherein the low mass and slight axial movement of the tensioning element permit the variable thread tensioning force to be applied to the sewing thread substantially without any inertial interference caused by said tensioning element.

2. A thread tensioning device according to claim 1, wherein the electromagnet is provided with a passage;

a friction member is disposed at one end of the electromagnet and has an application side that extends substantially perpendicular to the passage; and the mounting means comprises a bolt having a shank and a head at one end of said shank, the shank extending into the passage in the electromagnet to rotatably mount the tensioning element on the electromagnet so that the tensioning element is positioned between the head of the bolt and the application side of the friction member and so that axial movement of said tensioning element due to force applied by said electromagnet brings the tensioning element into frictional engagement with said friction member.

3. A thread tensioning device according to claim 2, wherein the bolt is constructed of non-magnetizable material.

4. A thread tensioning device according to claim 2, wherein the friction member is made of non-magnetizable material.

5. A thread tensioning device according to claim 2, wherein the bolt is constructed of magnetizable material.

6. A thread tensioning device according to claim 2, further comprising a control device for regulating a current flowing through the excitation winding.

7. A thread tensioning device according to claim 2, wherein the tensioning element comprises a flat side in contact with the application side of the friction member whereby varying the current in the excitation winding of the electromagnet causes the flat side of the tensioning element to be pressed with variable force against the application side of the friction member.

8. A thread tensioning device according to claim 2, wherein the electromagnet is a pot magnet and the excitation winding surrounds the shank of the bolt separated therefrom by an inner portion of said pot magnet.

9. A thread tensioning device according to claim 2, wherein the electromagnet is a pot magnet and the excitation winding directly surrounds the shank of the bolt.

10. A thread tensioning device according to claim 2, wherein the tensioning element comprises a wheel formed of a single part and defining a plane, the wheel having a plurality of radially extending fingers around its periphery, the plurality of fingers being bent alternately in opposite directions to project outward from the plane of the wheel to form a V-shaped incision for retaining the sewing thread around the periphery of the tensioning element.

11. A thread tensioning device according to claim 2, wherein the tensioning element comprises two disks, each of the discs defining a plane and having a plurality of radially extending fingers around its periphery, all of the respective fingers of each disc being bent in the same direction to project outward from the plane of the disk, a circumferential flange connecting the ends of all the respective fingers of each disc; and the discs being joined so that the fingers of the two discs cooperate to form a V-shaped incision around the periphery of the tensioning element.

12. A thread tensioning device according to claim 2, wherein the tensioning element comprises a wheel, the wheel defining a plane and having a plurality of radially extending fingers around its periphery, alternate fingers being bent in the same direction to project outward from the plane of the wheel so as to form a V-shaped incision, in cooperation with the other alternate fingers not bent out of the plane of the wheel, around the periphery of the tensioning element.

13. A thread tensioning device according to claim 2, wherein the electromagnet further comprises a lock screw, the lock screw being disposed radially in the electromagnet whereby the bolt is adjustably locked in position inside the passage.

14. A thread tensioning device according to claim 1, further comprising a control device for regulating a current flowing through the excitation winding.

15. A thread tensioning device according to claim 1, wherein the tensioning element has a mass of between 2.0 to 14.0 grams.

16. A thread tensioning device according to claim 1, wherein the predetermined amount of axial movement is not greater than substantially 0.1 millimeter.

17. A thread tensioning device according to claim 14, wherein the control device includes means for reducing the thread tensioning force applied to the sewing thread upon the cutting of the sewing thread.

18. A thread tensioning device according to claim 14, wherein the control device includes means for adjusting the thread tensioning force acting on the sewing thread.

19. A thread tensioning device according to claim 14, wherein the control device includes means for varying the thread tensioning force acting on the sewing thread within a stitch which is to be produced during operation of the sewing machine.

* * * * *